US005088001A

United States Patent [19]

Yaworski et al.

[11] Patent Number: 5,088,001

[45] Date of Patent: Feb. 11, 1992

[54] SURGE ARRESTER WITH RIGID INSULATING HOUSING

[75] Inventors: Harry G. Yaworski, Easton, Pa.; Larry N. Siebens, Port Murray, N.J.

[73] Assignee: Amerace Corporation, Parsippany, N.J.

[21] Appl. No.: 483,656

[22] Filed: Feb. 23, 1990

[51] Int. Cl.[5] ..... H02H 9/04

[52] U.S. Cl. ..... 361/127; 361/117; 338/21

[58] Field of Search ..... 361/117, 124, 126, 127, 361/128; 338/21

[56] References Cited

U.S. PATENT DOCUMENTS

| | | | |
|---|---|---|---|
| 4,404,614 | 9/1983 | Koch et al. | 361/126 |
| 4,899,248 | 2/1990 | Raudabaugh | 361/127 |
| 4,905,118 | 2/1990 | Sakich | 361/117 |
| 4,962,440 | 10/1990 | Johnnfelt et al. | 361/126 |
| 4,992,906 | 2/1991 | Docne et al. | 361/117 |

*Primary Examiner*—Todd E. DeBoer
*Attorney, Agent, or Firm*—Lerner, David, Littenberg, Krumholz & Mentlik

[57] ABSTRACT

To control the direction of movement and prevent random scattering of fragments of MOV blocks resulting from the catastrophic failure of such blocks during overvoltage incidents, a stack of such MOV blocks with end fittings attached is placed within a rigid filament-wound epoxy-impregnated tube formed as one continuous tube or a tube made up of aligned tube segments positioned so as to establish a preferred failure direction; the interstices between the interior of such tube and the exterior of said blocks and end fittings are filled with a dielectric insulative material which extends beyond and engulfs said tube and said end fittings to seal and further rigidify said component stack and provide an air-free non-electrically ionizable environment about said component stack.

20 Claims, 2 Drawing Sheets

SURGE ARRESTER WITH RIGID INSULATING HOUSING

BACKGROUND OF THE INVENTION

1. Field of the Invention

The invention is directed to the field of surge arresters used to attempt to protect high voltage systems from the effects of overvoltage incidents created by lightning strikes and more particularly to the construction of such surge arresters to attempt to prevent injury to personnel or equipment due to the catastrophic failure of such surge arresters during overvoltage incidents.

2. Description of the Prior Art

In surge arresters of the prior art, MOV blocks are stacked together and capped at each end with a fitting including a threaded stud. The block and cap stack is then placed in an elastomeric housing through an open end with one of the studs projecting from the housing closed end for connection to a support or connector probe. A metal cap is fixed over the open end of the housing with the second stud projecting therethrough for connection to a ground conductor. Although the elastomeric housing supporting the cap is locally weakened to encourage the downward movement of fragments of the MOV blocks and fittings should these elements fracture due to catastrophic failure of the arrester, the elastomeric housing possesses insufficient strength to prevent the scattering of fragments, contain them and force them downwardly to minimize injury to persons in proximity to the arrester or nearby equipment.

In U.S. Pat. No. 4,404,614 issued Sep. 13, 1983, a surge arrester made up of a number of blocks 30 is placed in an EPDM rubber housing 12. To add structural integrity to the arrester "an inner tubular liner 36 disposed concentrically within and extending the entire length of chamber 14 between the internal components of the latter and the inner surface of the housing 12. This liner is constructed of a material having a high bursting strength, preferably resin-impregnated fiberglass (specifically epoxy resin-impregnated filament-wound fiberglass). An intermediate sleeve 38 is disposed concentrically between and extends the entire length of liner 36 and the inner surface of housing 12. This sleeve is constructed of a moisture-impervious material preferably glass flakes in an epoxy matrix."

Such an arrangement provides added strength but fails to provide an air-free non-electrically ionizable environment about the arrester blocks to minimize internal electrical arcing which can lead to block destruction during overvoltage incidents.

The patent to Thuillier, U.S. Pat. No. 4,864,456 issued Sep. 5, 1989, shows a lightning arrester which uses a filament winding to provide radial binding without significant axial compression. "The filament winding thus has the sole function of holding the pellets together . . . " It also adheres to the pellets and the spacers but because of the undulating surface of pellets and spacers, the air is not eliminated within housing 5 or between the winding 4 and the pellets 1 and spacers 2.

To provide a surge arrester having excellent heat transfer properties and improved tensile and cantilever strengths, U.S. Pat. No. 4,656,555 issued Apr. 7, 1987, uses a wrap of filament windings 14 over MOV blocks 11, 12 and terminal pieces 16, 18 before insertion in a weathershed housing 20. The arrangement of windings 14 and blocks 11, 12 are not sealed against the intrusion of air therebetween.

Bergh et al., U.S. Pat. No. 4,467,387 issued Aug. 21, 1984, shows a wound tube 22 of glass fibers in bonding resin but spaced from blocks 42 by elastomeric sleeves **42*a* and resilient balls 44. Air can be entrapped adjacent the blocks 42 inside the insulative tube 22. U.S. Pat. No. 4,851,955 issued July 25, 1989, to Doone et al. shows MOV blocks 2 in a glass-reinforced plastic shell 5 within heat-shrink sleeve 6. Shell 5 is bonded to the outer surfaces of MOV blocks 2, heat sink/spacer blocks 3 and terminal blocks 4**.

SUMMARY OF THE INVENTION

The present invention overcomes the difficulties present in prior art devices and manufacturing techniques by replacing the in-situ formation of epoxy-impregnated filament windings used to assemble a stack of MOV blocks and end fittings and provide structural integrity to the stack with a preformed and tested epoxy-impregnated filament winding tube of selected dimensions and strength and which can be positioned with respect to the stack to contain same and to establish a desired direction of movement of fragments of such blocks should same catastrophically fail during overvoltage incidents. Additionally, the tube can be formed by two or more tube segments, laid end to end but not mechanically joined other than by the filler set forth below. A filler of a suitable dielectric insulating material such as a thermoset or thermoplastic material, an epoxy or a liquid crystal polymer is injected between the MOV blocks and the tube to fill the interstices establishing an air-free non-electrically-ionizable environment. The filler is permitted to extend beyond and engulf the tube and a portion of the end fittings to provide a rigid, sealed assembly. It is an object of this invention to provide an improved surge arrester.

It is an object of this invention to provide an improved surge arrester employing MOV blocks and end fittings with a rigid insulating housing.

It is still another object of this invention to provide an improved surge arrester employing MOV blocks and end fittings with a rigid insulating housing comprising a rigid tube of wound epoxy-impregnated fiberglass filaments.

It is yet another object of this invention to provide an improved surge arrester employing MOV blocks and end fittings with a rigid insulating housing comprising a rigid tube of wound epoxy-impregnated fiberglass filaments so positioned with respect to the MOV blocks of said arrester as to provide a direction of movement of fragments of said blocks in the event said blocks fail during voltage overload incidents.

It is another object of this invention to provide an improved surge arrester employing MOV blocks and end fittings with a rigid insulating housing comprising a rigid tube of wound epoxy-impregnated fiberglass filaments, the interstices between the outer surfaces of said blocks and end fittings and said tube being filled with a dielectric insulating material to provide an air-free, non-electrically ionizable environment and to rigidify the assembly by engulfing the tube and end fittings to form a unitary assembly.

It is still another object of this invention to provide an improved surge arrester employing MOV blocks and end fittings with a rigid insulating housing comprising a rigid tube of end-to-end segments of wound epoxy-impregnated fiberglass filaments so positioned with respect to the MOV blocks of said arrester as to attempt to establish a direction of movement of fragments of said blocks in the event said blocks fail during voltage overload incidents.

Other objects and features of the invention will be pointed out in the following description and claims and illustrated in the accompanying drawings which disclose, by way of example, the principles of the invention and the best mode which has been contemplated for carrying it out.

BRIEF DESCRIPTION OF THE DRAWING

In the drawing in which similar elements are given similar reference characters.

DESCRIPTION OF THE PREFERRED EMBODIMENT

Figure 1:
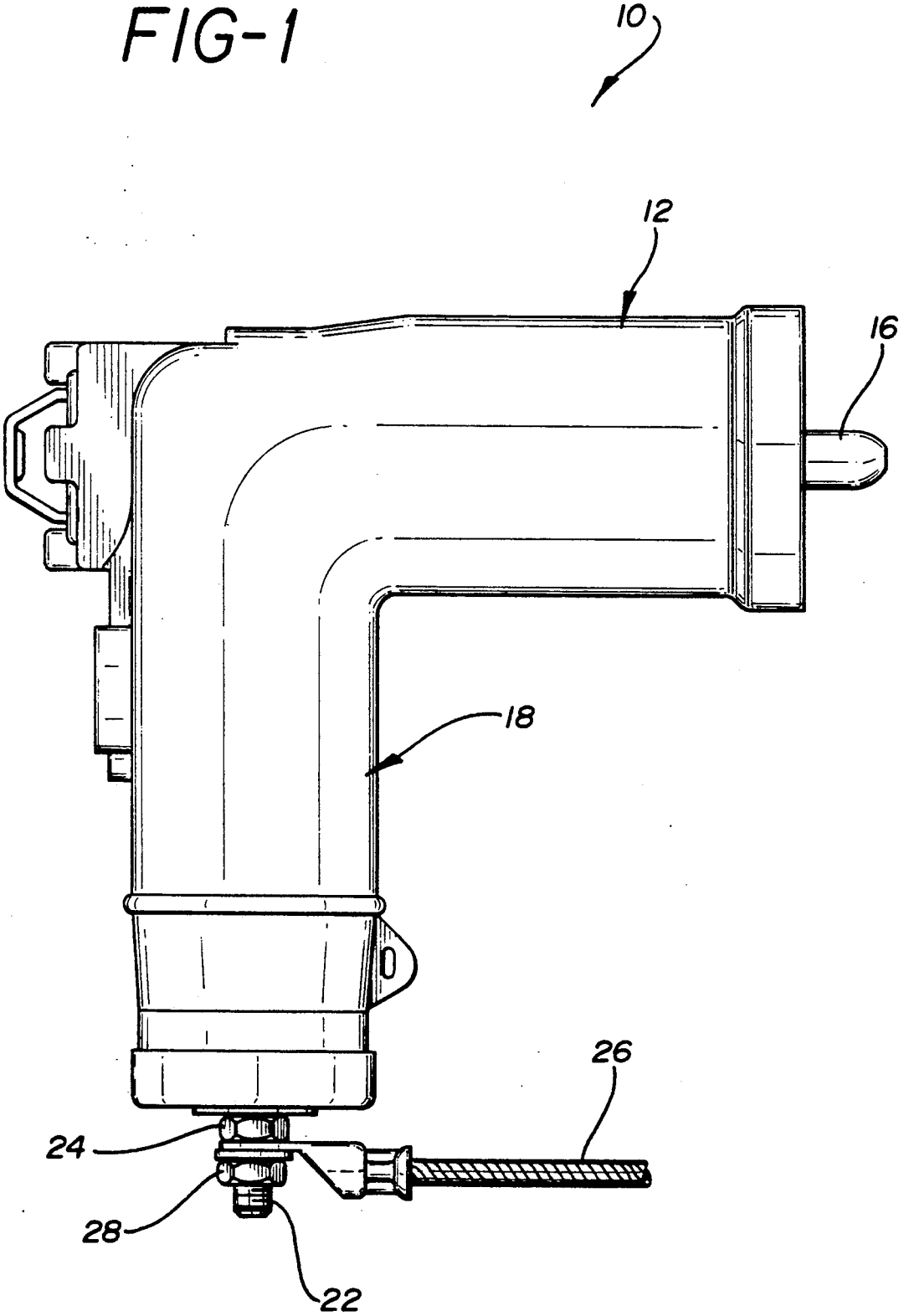
FIG. 1 is a side elevation of a surge arrester in the form of a high voltage elbow connector constructed in accordance with the concepts of the invention.
Figure 2:
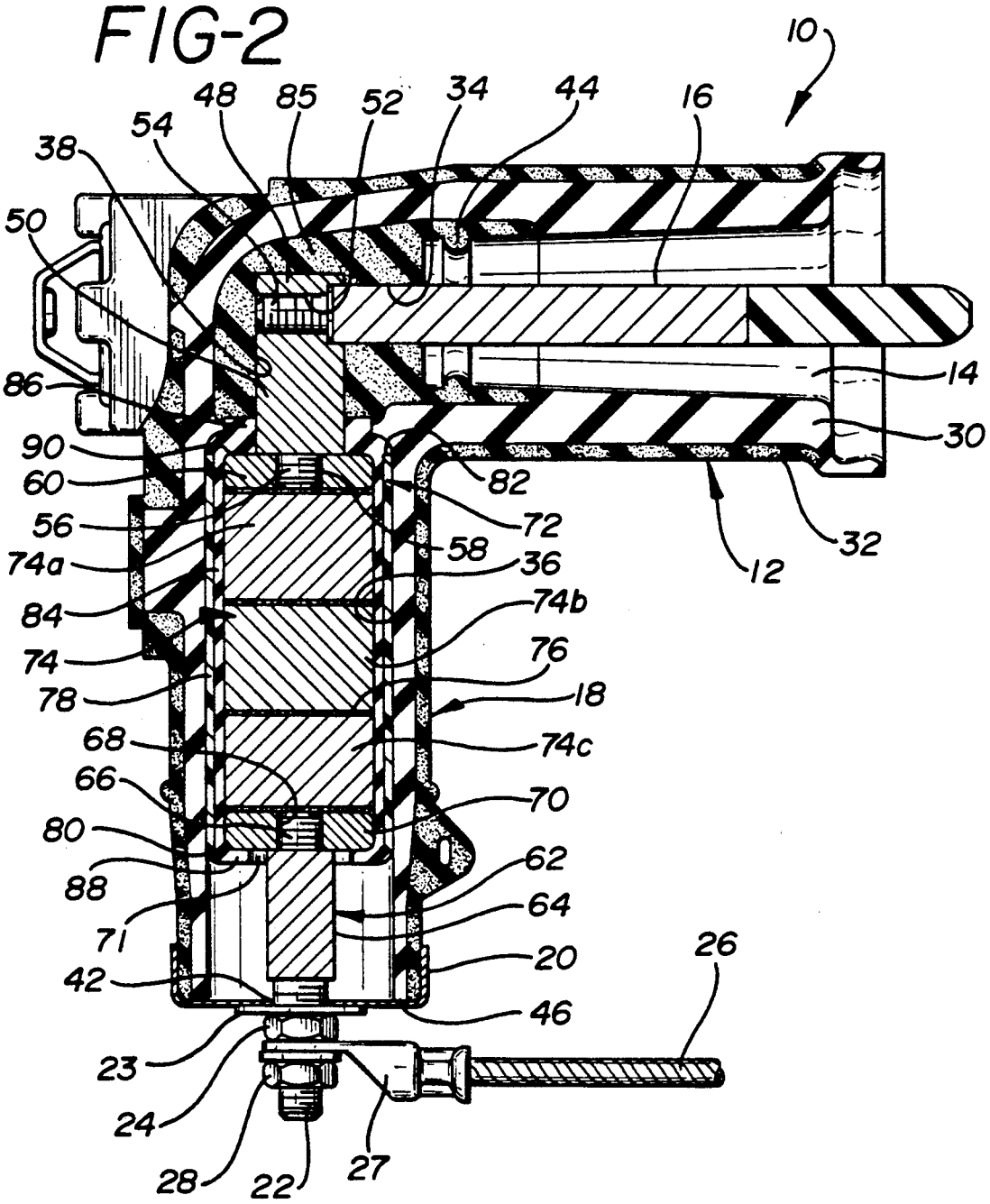
FIG. 2 is a sectional view of the connector of FIG. 1.

Turning now to FIGS. 1 and 2, there is shown a surge arrester 10 in the form of a high voltage elbow connector constructed in accordance with the concepts of the invention. Although the surge arrester construction is shown housed in an elbow configuration as used in the underground distribution of high voltage currents, it is equally applicable to terminators and transmission line supports and protectors for above-ground transmission or distribution lines and circuits.

A body 30 of resilient, non-tracking insulating material such as EPDM rubber or butyl rubber is formed in a generally L-shape with a horizontal leg 12 and a vertical leg 18. A shielding layer 32 of conductive material such as semi-conductive EPDM rubber or butyl rubber is placed over a major portion of body 30 (see FIG. 2). Leg 12 is tapered to form a receptacle 14 to receive therein the interface of a bushing insert (not shown) and probe 16 is arranged to engage with the female contact thereof in known manner. The female contact (not shown) engages the probe 16 and extends within receptacle 14 of leg 12. The elbow connector is locked to the bushing insert by engagement of annular detent rib 44 with an annular recess in the bushing insert (not shown). The end 46 of vertical leg 18 is sealed with a metal cap 20. The metal cap 20 is connected via metallic coupling 62 to the reinforced surge arrester assembly 72 with the intention that it separate from leg 18 or fracture to permit the contents of leg 18 to move downwardly as will be described in detail below.

Within leg 18 is a bore 36 extending substantially the entire length of leg 18 and terminating at one end in a reduced bore 38 communicating with bore 34 of leg 12. At the opposite end, bore 36 extends through end 46 of leg 18 and in turn communicates with bore 42 extending through cap 20. A first metallic coupling 48 having a central portion 50 positioned in bore 38 and internally threaded as at 52 to receive the externally threaded portion 54 of probe 16. The externally-threaded portion 56 is threaded into an internally threaded aperture 58 of end fitting 60.

A second metallic coupling 62, having a central portion 64, is positioned in bore 36 adjacent cap 20 and has an externally-threaded portion 66 threadably engaged with internally-threaded aperture 68 of end fitting 70. A second externally-threaded portion 22 extends through bore 42 in cap 20, plate 23, and is engaged by a first nut 24 providing a large contact area. A ground conductor 26, having a suitable fitting 27, may be fixed in place against nut 24 by a second nut 28.

Within cavity 36 is placed the reinforced surge arrester assembly 72 according to the present invention. The surge assembly 72 consists of a number of metal oxide varistor (MOV) blocks 74, of the type commercially available from Meidensha for example, and preferably comprise zinc oxide non-linear resistor material such that they become highly conductive in the presence of high voltages as during a lightning strike and return to their normal high resistance condition under normal voltage levels. Although three blocks 74 are shown, the number and size of blocks employed will depend upon the circuit rating as is well known.

A first metallic end fitting 60 is placed at the top of the stack of blocks 74 adjacent block **74*a* and a second metallic end fitting 70 is placed at the bottom of the stack of blocks 74 adjacent block 74*c*. These end fittings 60, 70 are made of any suitable metal and preferably from aluminum. The interfaces between each of the blocks 74*a*, 74*b* and 74*c* and of the blocks 74*a*, 74*c* and end fittings 60 and 70, respectively, are filled with a conductive adhesive 76 such as a silver epoxy paste. A preformed rigid tube 78 is placed about but not in contact with the blocks 74 and end fittings 60, 70. End 82 of tube 78 is positioned above the top surface 90 of end fitting 60 to provide a relatively stronger region adjacent end fitting 60 as compared to the region adjacent end fitting 70 and thus establish a preferred downward direction of movement for any fragments of the assembly 72** should it fracture as hereinafter described.

Figure 3:
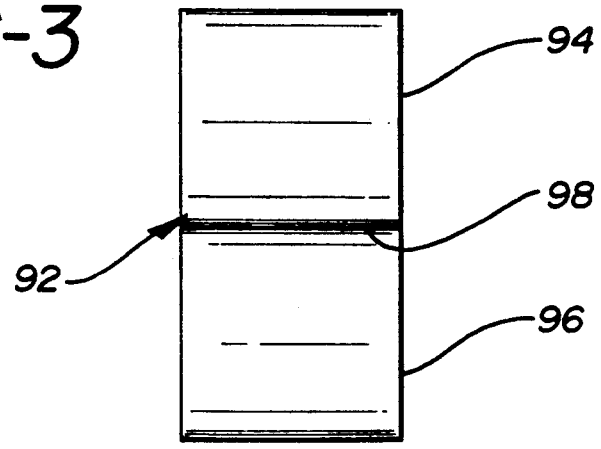
FIG. 3 is a side elevational view of an alternative construction of the rigid tube of FIG. 2.

In addition, the preformed rigid tube 92, as shown in FIG. 3, may be made up of two or more segments such as 94 and 96 laid end to end, in line but not Joined except for the filler layer as set out below. This segmenting increases the tendency of assembly 72 to move downwardly particularly below the line of contact 98 of segments 94, 96. Tube 78 is formed of filament windings of any suitable continuous fiber such as nylon, rayon, glass and polyethylene. Other fibers such as ceramic fibers may be used although a glass filament winding is preferred. The filament windings may be in the form of a single fiber or each winding may be comprised of many smaller strands. The filament windings are impregnated with a resinous material which may be natural or synthetic and may be in the partially cured or uncured state. Epoxy resins are preferred. The resins are fully cured so that the resulting tube 78 is rigid. The inside diameter of tube 78 is made greater than the outside diameter of the blocks 74 and end fittings 60, 70.

The end fittings 60, 70 are connected to a suitable fixture using threaded apertures 58 and 68 and the stack of blocks 74 and end fittings 60, 70 are placed inside of and spaced from the inside walls of tube 78 and the entire assembly placed in a mold cavity. The interstices are now filled with a suitable dielectric insulating material such as a thermoset or thermoplastic resin such as glass-filled nylon by injection molding. The material fills all space between the outer surface of the blocks 74 and the inner surface of tube 78 to form a filler layer 84 which provides an air-free, non-electrically ionizable environment. The filler layer is also permitted to extend beyond the ends 80, 82 of tube 78 and overlie such ends 80, 82 to lock tube 78 to filler layer 84. In the case of the segmented tube 92, filler layer 84 also serves to hold segments 94, 96 in position. Further, ends 86 of filler layer 84 overlie most of the exposed surface 90 of end fitting 60 while ends 88 overlie most of the exposed surface 71 of end fitting 70 to seal assembly 72. The relative dimensions of the components are as follows: for MOV blocks, 1-inch thick, end fittings ¼-inch thick and, disregarding the thickness of the glue layers 76, tube 78 will be 3½ inches long and filler layer 84, ends 86 and 88 will be 4½ inches in length. The MOV blocks 74 are 1¼ inches in diameter, the tube 78 will have an outside diameter of 1½ inches and is 62 mils thick and the filler layer 84 will be approximately 62 mils thick.

Assembly 72 will now have couplings 48 and 62 assembled to end fittings 60 and 70, respectively, and a metal mandrel will be fixed to coupling 48 with a semi-conductive EPDM rubber insert 85 chemically bonded to and covering coupling 48; the resulting assembly will be placed in a suitable mold cavity. Insulative EPDM rubber 30 will now be injection molded between the resulting assembly and a semi-conductive EPDM rubber 32 to complete the surge arrester 10 providing an air-free non-electrically ionizable environment between assembly 72 and the electrically-grounded semi-conductive EPDM rubber of cap 20 and shield 32.

Due to the high hoop strength provided by tube 78, it acts as a pressure vessel which contains or deflects any fragments of the MOV which may result from a failure of the blocks during voltage overload instances. The open end of tube 78 in concert with the upward displacement of tube 78 relative to the top of the stack of blocks 74 results in a natural downward direction of movement from assembly 72 of any high energy fragments of exploding MOV blocks which cannot be contained within body 30. Segmenting of the tube 92 enhances the preferred downward direction of movement of assembly 72. Also, the lack of mechanical connection of cap 20 to leg 18 permits the downward movement of any fragments of the MOV blocks 74, the tube 78, filler layer 84 in vertical leg 18.

The MOV blocks 74 may fail due to the establishment of a short circuit arc in the blocks due to overvoltages caused by a lightning strike or the follow current flowing into the blocks after the strike. The elimination of the air about the blocks 74 minimizes such arcs and provides an air-free, non-electrically ionizable environment for the MOV blocks 74 to reduce catastrophic failures of the blocks during overvoltage incidents and thus minimize injury to persons working in the area of the arrester or damage to adjacent equipment.

While there have been shown and described and pointed out the fundamental novel features of the invention as applied to the preferred embodiment, it will be understood that various omissions and substitutions and changes of the form and details of the device illustrated and in its operation may be made by those skilled in the art without departing from the spirit of the invention.

What is claimed is:

1. A surge arrester comprising:

at least one cylindrical metal oxide varistor block having a first end and a second end and an outer peripheral surface between said first end and said second end;

two metal end fittings, one adjacent each of said first and second ends;

a rigid dielectric insulating tube having an inside diameter larger than the outer diameter of the outer peripheral surface of said block; and a dielectric material layer between the interior surface of said tube and the outer peripheral surface of said block to completely fill the space between said tube and said at least one varistor and said end fittings, said material layer extending beyond the ends of said tube and over at least a portion of the free end surfaces of said end fittings to seal said end fittings and said block and lock said tube thereto.

2. A surge arrester as defined in claim 1, wherein said tube comprises resin-impregnated fiberglass.

3. A surge arrester as defined in claim 2, wherein said material layer is a thermoplastic resin.

4. A surge arrester as defined in claim 2, wherein said material layer is a thermoset resin.

5. A surge arrester as defined in claim 1, wherein said tube comprises an epoxy resin-impregnated filament-wound fiberglass tube.

6. A surge arrester as defined in claim 5, wherein said material layer is glass-filled nylon.

7. A surge arrester as defined in claim 1, wherein said tube comprises a resin-impregnated fiberglass tape.

8. A surge arrester as defined in claim 1, wherein said material layer is a thermoplastic resin.

9. A surge arrester as defined in claim 1, wherein said material layer is a thermoset resin.

10. A surge arrester comprising:

at least two cylindrical metal oxide varistor blocks, each having a first end and a second end and a first thickness, and an outer peripheral surface between said first and said second end said blocks arranged in a stacked end-to-end arrangement;

two metal end fittings, each having a first end and a second end, and a second thickness and an outer peripheral surface between said first and second end of said end fittings one of said end fittings being adjacent each one of the free ends of said stacked block arrangement;

a rigid insulating tube having an inside diameter larger than the outer diameter of the outer peripheral surface of said blocks;

and a dielectric insulative material layer between the interior surface of said tube and the outer peripheral surface of said blocks to completely fill the space between said tube and said at least one varistor and said end fittings to prevent any contact between said block and said tube and eliminate any air therebetween said material layer extending beyond the ends of said tube and over at least a portion of the free end surfaces of said end fittings to seal said end fittings and said blocks and lock said tube thereto.

11. A surge arrester as defined in claim 10, wherein said tube comprises resin-impregnated fiberglass.

12. A surge arrester as defined in claim 10, wherein said tube is equal in length to the combined first thicknesses of each of said blocks and the second thicknesses of both of said end fittings and one end of said tube is positioned beyond the free first end of a first of said end fittings placed adjacent the top of said stacked blocks.

13. A surge arrester as defined in claim 12, wherein the second end of said tube is above the line of the free second end of the second of said end fittings placed adjacent the bottom of said stacked blocks.

14. A surge arrester as defined in claim 12, wherein said tube is formed of the segments stacked along a common longitudinal axis.

15. A surge arrester as defined in claim 10, wherein said tube comprises an epoxy resin-impregnated filament-wound fiberglass tube.

16. A surge arrester as defined in claim 10, wherein said tube comprises a resin-impregnated fiberglass tape.

17. A surge arrester as defined in claim 10, wherein said material layer is a thermoplastic resin.

18. A surge arrester as defined in claim 10, wherein said material layer is a thermoset resin.

19. A surge arrester as defined in claim 10, wherein said material layer is glass-filled nylon.

20. A surge arrester as defined in claim 10, wherein said tube comprises an epoxy resin-impregnated filament-wound fiberglass tube and said material layer is glass-filled nylon.

* * * * *